US006314837B1

(12) United States Patent
Nevaril

(10) Patent No.: US 6,314,837 B1
(45) Date of Patent: Nov. 13, 2001

(54) HAMMER PROTECTIVE SYSTEM

(76) Inventor: Scott Nevaril, 5063 Klusman Ave., Alta Loma, CA (US) 91730

( * ) Notice: Subject to any disclaimer, the term of this patent is extended or adjusted under 35 U.S.C. 154(b) by 0 days.

(21) Appl. No.: 09/657,728

(22) Filed: Sep. 8, 2000

Related U.S. Application Data

(63) Continuation-in-part of application No. 09/220,195, filed on Dec. 23, 1998, now abandoned.

(51) Int. Cl.[7] ..... B25D 1/00
(52) U.S. Cl. ..... 81/20; 81/22
(58) Field of Search ..... 81/20, 22

(56) References Cited

U.S. PATENT DOCUMENTS 4,172,483 * 10/1979 Bereskin ..... 81/20
4,352,381 * 10/1982 Provi ..... 81/20 X

* cited by examiner

*Primary Examiner*—James G. Smith
(74) *Attorney, Agent, or Firm*—Golstein Law Offices, P.C

(57) ABSTRACT

A hammer protective device, used in conjunction with a hammer having a handle portion and a head portion. The head portion has a shank portion for mounting the handle. The invention comprises a diametrically expandable rubber sheath having a generally cylindrical configuration. The rubber sheath has a relaxed diameter which is slightly less than a diameter of the handle portion. The rubber sheath has an open upper end and an open lower end. The rubber sheath includes an embedded pull cord assembly disposed interiorly thereof. The embedded pull cord assembly is arranged in a coil type arrangement and is rigid, resisting compression and thus holding the sheath in an expanded position. The embedded pull cord assembly has a central lumen which is larger in diameter than the handle portion. The embedded pull cord assembly thereby holds the diameter of the rubber sheath greater than the diameter of the handle portion prior to installation of the protective device wherein the rubber sheath is positioned over the handle portion and the shank portion with the handle portion extending through the central lumen. The pull cord has a free upper end that extends lengthwise within the central lumen and terminates outwardly of the open lower end thereof such that pulling on the free upper end will systematically remove the pull cord from within the rubber sheath thereby allowing the rubber sheath to relax and snugly engage the handle portion and the shank portion of the hammer.

4 Claims, 3 Drawing Sheets

FIG 3
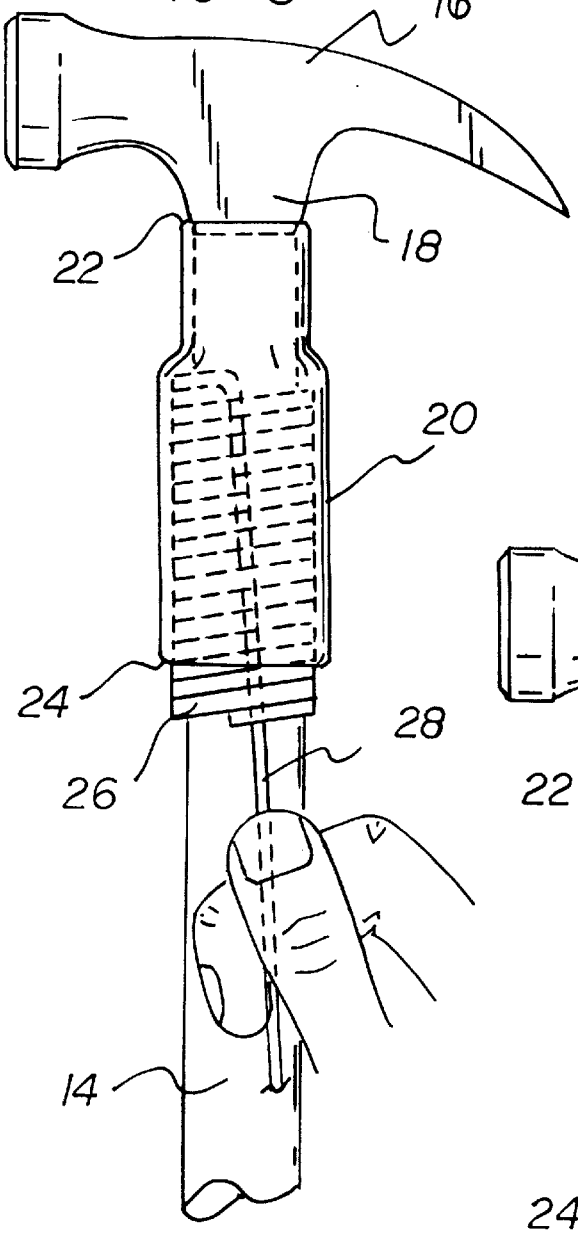
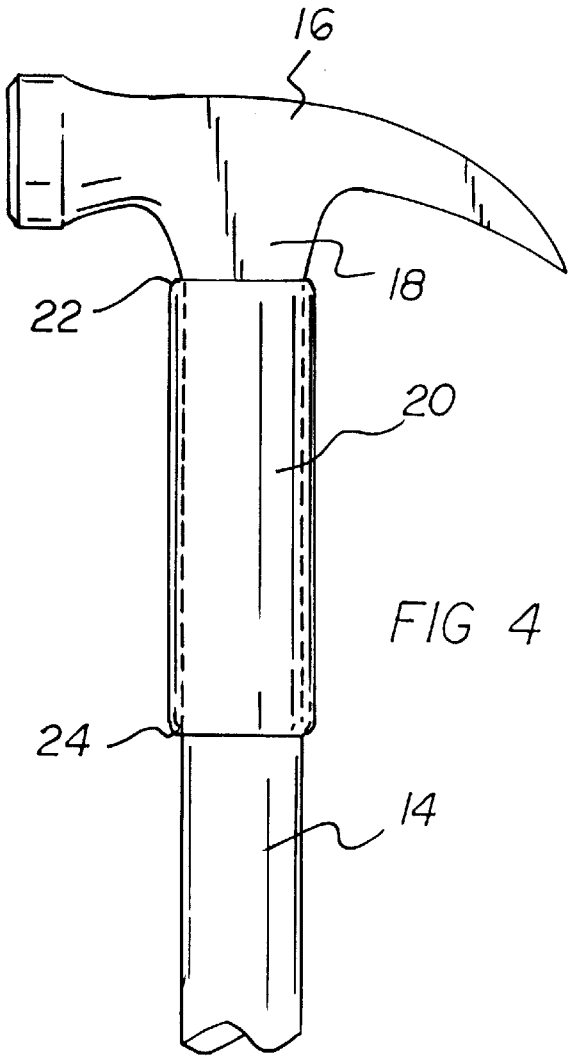
FIG 4

HAMMER PROTECTIVE SYSTEM

CROSS REFERENCES AND RELATED SUBJECT MATTER

This application is a continuation-in-part of patent application Ser. No. 09/220,195, filed in the United States Patent Office on Dec. 23, 1998 now abandoned.

BACKGROUND OF THE INVENTION

1. Field of the Invention

The present invention relates to a hammer protecting system and more particularly pertains to a protective sleeve which snugly encases a portion of a hammer in order to protect the hammer against breaking, and a manner of installing the protective sleeve with only minimal effort.

2. Description of the Prior Art

It is well known that hammers occasionally break during usage. In particular, the narrowing or the handle where it is joined with the hammer head creates a weak structural point. In addition, undamped vibrations serve to weaken the hammer in time. When a hammer breaks, sending the hammer head flying, damage to the surroundings or injury to a worker will almost certainly occur.

The use of hammer protective devices is known in the prior art. More specifically, hammer protective devices and schemes heretofore devised and utilized for the purpose of damping vibrations are known to consist basically of familiar, expected and obvious structural configurations, notwithstanding the myriad of designs encompassed by the crowded prior art which have been developed for the fulfillment of countless objectives and requirements.

By way of example, U.S. Pat. Nos. 3,968,843 to Shotwell; 5,289,742 to Vaughan, Jr.; and 5,490,437 to Herbert.

While these devices fulfill their respective, particular objective and requirements, the aforementioned patents do not describe an effective protective device for hammers for preventing a hammer from breaking from impacts, which may be installed with great ease.

In this respect, the hammer protecting system according to the present invention substantially departs from the conventional concepts and designs of the prior art, and in doing so provides an apparatus primarily developed for the purpose of preventing a hammer from breaking from impacts.

Therefore, it can be appreciated that there exists a continuing need for new and improved hammer protective systems which can be used for preventing a hammer from breaking from impacts. In this regard, the present invention substantially fulfills this need.

SUMMARY OF THE INVENTION

In the view of the foregoing disadvantages inherent in the known types of hammers now present in the prior art, the present invention provides an improved hammer protecting system. As such, the general purpose of the present invention, which will be described subsequently in greater detail, is to provide a new and improved hammer protecting system which has all the advantages of the prior art and none of the disadvantages.

To attain this, the present invention is used in conjunction with a hammer having a wooden handle portion and a head portion. The head portion has a downwardly depending shank portion for receiving an upper end of the wooden handle portion therein to facilitate securement of the wooden handle portion to the head portion. The invention comprises a diametrically expandable rubber sheath having a generally cylindrical configuration. The rubber sheath has a relaxed diameter which is slightly less than a diameter of the handle portion. The rubber sheath has an open upper end and an open lower end. The rubber sheath includes an embedded pull cord assembly disposed interiorly thereof. The embedded pull cord assembly arranged in a coil type arrangement, and is rigid, resisting compression and thus holding the sheath in an expanded position. The embedded pull cord assembly has a central lumen which is larger in diameter than the handle portion. The embedded pull cord assembly thereby holds the diameter of the rubber sheath greater than the diameter of the handle portion prior to installation of the protective device wherein the rubber sheath is positioned over the handle portion and the shank portion with the handle portion extending through the central lumen. The pull cord has a free upper end that extends lengthwise within the central lumen and terminates outwardly of the open lower end thereof such that pulling on the free upper end will systematically remove the pull cord from within the rubber sheath thereby allowing the rubber sheath to relax and snugly engage the handle portion and the shank portion of the hammer.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved hammer protecting system which has all the advantages of the prior art hammer protecting systems and none of the disadvantages.

It is another object of the present invention to provide a new and improved hammer protecting system which may be easily and efficiently manufactured and marketed.

It is a further object of the present invention to provide a new and improved hammer protecting system which is of durable and reliable construction.

An even further object of the present invention is to provide a new and improved hammer protecting system which is susceptible of a low cost of manufacture with regard to both materials and labor, and which accordingly is then susceptible of low prices of sale to the consuming public, thereby making such a protective device for hammers economically available to the buying public.

Even still another object of the present invention is to provide a new and improved hammer protecting system for preventing a hammer from breaking from impacts.

Lastly, it is an object of the present invention to provide a new and improved hammer protecting system including a rubber sheath which is initially held in an expanded position by a coil assembly prior to installation, wherein the coil is unraveled to allow the rubber sheath to relax and seat firmly upon the hammer.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a side view of the present invention wherein the pull cord is being removed and the rubber sheath is relaxing into a tight fit upon the hammer handle and shank.

FIG. 4 is side view of the present invention wherein the pull cord has been fully removed and the rubber sheath is permanently installed tightly upon the hammer handle and shank.

Similar reference numerals refer to the similar parts through the various figures.

DESCRIPTION OF THE PREFERRED EMBODIMENT

Figure 1:
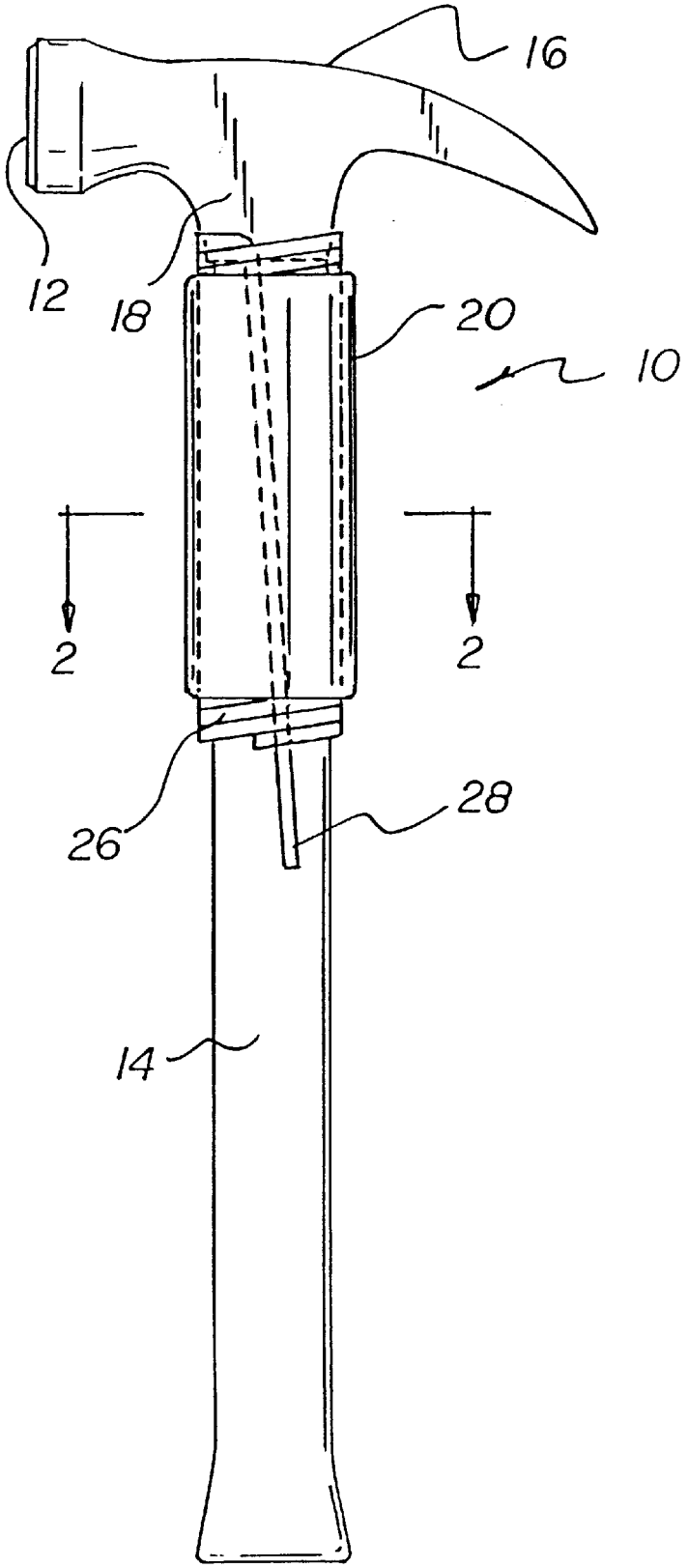
FIG. 1 is a side view of the preferred embodiment of the hammer protecting system constructed in accordance with the principles of the present invention.
Figure 2:
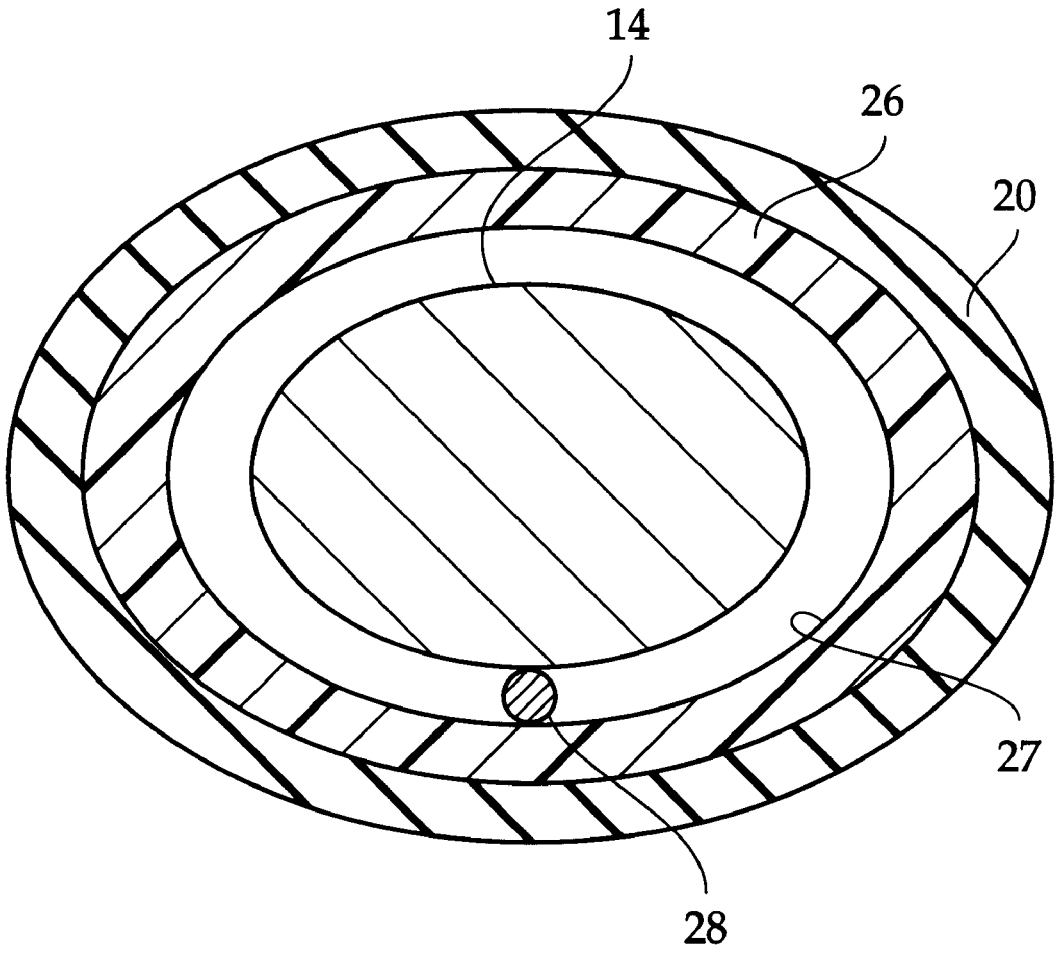
FIG. 2 is a cross-sectional view of the present invention as taken along line 2—2 of FIG. 1.

With reference now to the drawings, and in particular, to FIGS. 1 through 4 thereof, the preferred embodiment of the new and improved hammer protecting system embodying the principles and concepts of the present invention and generally designated by the reference number 10 will be described.

Specifically, it will be noted in the various Figures that the invention relates to a hammer protecting system for preventing a hammer which employs a hammer protective device 10 which is installed upon a hammer 12. Such components are individually configured and correlated with respect to each other so as to attain the desired objective.

The hammer 12 has a wooden handle portion 14 and a head portion 16. The head portion 16 has a downwardly depending shank portion 18 for receiving an upper end of the wooden handle portion 14 therein to facilitate securement of the wooden handle portion 14 to the head portion 16.

The hammer protective device 10 has a rubber sheath 20 having a generally cylindrical configuration. The rubber sheath is flexible, capable of expanding in diameter, and retracting in a spring-like fashion. The rubber sheath 20 has an equilibrium or "relaxed" diameter which is slightly less than a diameter of the handle portion 14 of the hammer 12 with which it is to be used. The rubber sheath 20 has an open upper end 22 and an open lower end 24. Advantageously, the rubber sheath 20 would cover a part of the handle portion 14 and the part of the shank portion 18, and would fit tightly thereon. However, it would be extremely difficult to slide the rubber sheath 20 over the handle portion 14, since the rubber sheath 20 "wants" to be a diameter which is less than that of the handle over which it is to be applied.

Accordingly, the present invention employs an embedded pull cord assembly 26. The embedded pull cord assembly 26 comprises a tight coiling of a filament, wherein adjacent filaments in said coil are fused together to create a tube having a central lumen 27. The materials for the filament are selected so that the tube is rigid, resisting compression. However, the tube thus created can be unraveled by axially pulling upon the filament. A tube suitable for the purposes of the present invention is made of using plastic filaments, and is manufactured by 3M CORPORATION and is used for the purposes of electrical cable pipe insulation.

For the purposes of the present invention then, the sheath 20 extends over the embedded pull cord assembly 26, whereas the embedded pull cord 26 expands the diameter of the rubber sheath 20 so that it is greater than the diameter of the handle portion 14 for positioning the rubber sheath 20 over the handle portion 14 and the shank portion 18. In accordance therewith, the handle portion 14 is inserted through the central lumen 27, whereby the rubber sheath 20 is suitably positioned along the handle portion 14, and partially over the shank 18.

As previously indicated, the embedded cord 26 is arranged in a coil type arrangement. The pull cord 26 has a free upper end 28 that extends longitudinally lengthwise within the central lumen 27 of the rubber sheath 20 and terminates outwardly of the open lower end 24 thereof. Thus, axially pulling on the free upper end 28 will systematically remove the pull cord 26 from within the rubber sheath 20 thereby allowing the rubber sheath 20 to constrict to nearly its relaxed diameter whereby it snugly engages the handle portion 14 and the shank portion 18. Thus, the rubber sheath 20 will tightly secure the handle portion 14 to the shank portion 18 thereby damping vibrations and impact forces and in effect reducing the chances of the handle portion 14 breaking away from the shank portion 18.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A hammer protecting device for protecting a hammer having a handle portion having a diameter, and a head portion, the head portion having a shank portion which is attached to the handle portion, comprising:

a rubber sheath having a generally cylindrical configuration, the rubber sheath flexible in diameter such that it is capable of diametrically expanding and retracting, but having a relaxed diameter which is less than the diameter of the handle to which it is to be applied, the rubber sheath having an open upper end and an open lower end;

an embedded pull cord assembly comprising a filament wound into a coil which creates a tube having a central lumen, the coil rigid so as to resist inward compression, the rubber sheath initially expanded in diameter and extended fully over the embedded pull cord assembly, wherein the hammer handle and shank is inserted through the central lumen and the coil is unwound, thereby allowing the rubber sheath to constrict into its relaxed position whereby it tightly encases the handle and shank.

2. The hammer protecting device as recited in claim 1, wherein the embedded pull cord assembly further comprises a free upper end that extends lengthwise within the central lumen and terminating outwardly of the open lower end of the rubber sheath whereby pulling on the free upper end will systematically remove the pull cord from within the rubber sheath.

3. A hammer protecting method, for protecting a hammer having a handle portion having a diameter, and a head portion, the head portion having a shank portion which is attached to the handle portion, providing a rubber sheath of expandable diameter having a relaxed diameter which is less than the diameter of the handle portion;

providing a pull cord assembly in the form of a rigid tube having a central lumen, formed of a tight coil of a filament;

expanding the rubber sheath by extending the rubber sheath over the pull cord assembly;

inserting the handle of the hammer through the central lumen; and constricting the rubber sheath over the handle by removing the pull cord assembly.

4. The hammer protecting method as recited in claim 3, wherein the pull cord has a free end, and wherein the step of removing the pull cord assembly further comprises axially pulling upon free end of the pull cord to unravel the coil thereof.

* * * * *